US005909928A

United States Patent [19]

Barish

[11] Patent Number: 5,909,928

[45] Date of Patent: Jun. 8, 1999

[54] ELECTRICAL HAIR REMOVER DEVICE AND METHOD

[76] Inventor: Benjamin J. Barish, 36 Yehuda Hanasi Str. Ramat Aviv, Tel Aviv, Israel, 69206

[21] Appl. No.: 08/951,645

[22] Filed: Oct. 16, 1997

[51] Int. Cl.[6] ..... B26B 19/00

[52] U.S. Cl. ..... 30/41.5; 30/34.05

[58] Field of Search ..... 30/34.05, 41.5, 30/133, 43.6

[56] References Cited

U.S. PATENT DOCUMENTS 3,364,568 1/1968 Lowy ..... 30/41.5 X

*Primary Examiner*—Douglas D. Watts

[57] ABSTRACT

An electrical hair remover device particularly a rotary shaver includes an air impeller driven by the motor for discharging air through openings in the shaver head such as to produce an air cushion reducing friction between the head and the surface over which it is moved.

20 Claims, 1 Drawing Sheet

FIG. 1
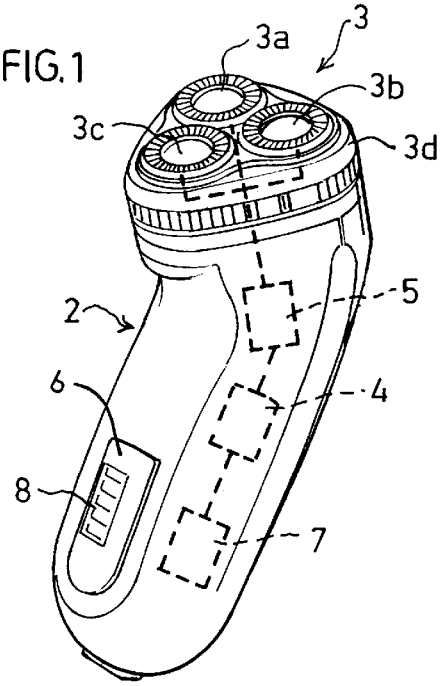
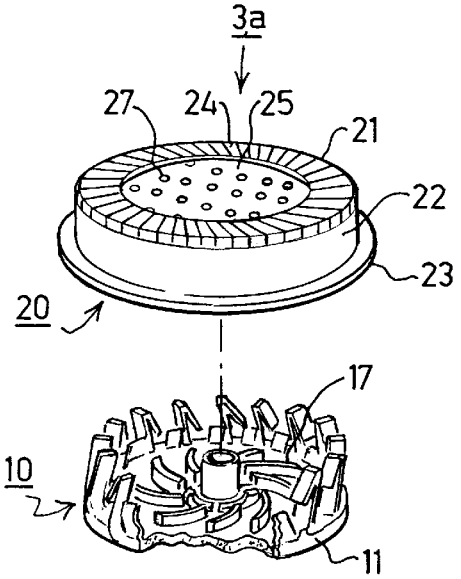
FIG. 2
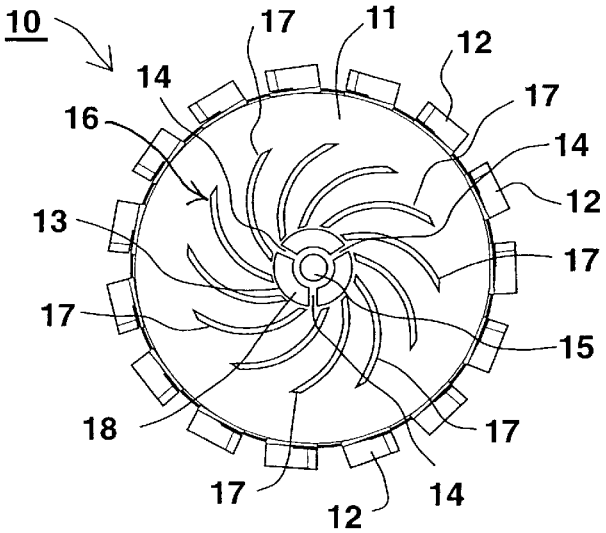
FIG. 3
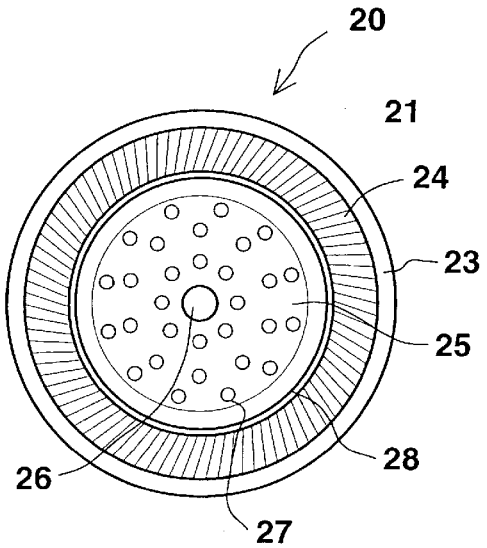
FIG. 4

ELECTRICAL HAIR REMOVER DEVICE AND METHOD

FIELD AND BACKGROUND OF THE INVENTION

The present invention relates to an electrical hair remover device, and also to a method of removing hair. The invention is particularly useful in electrical shavers and is therefore described below with respect to that application.

In order to obtain a fairly close shave with an electrical shaver, it is necessary to firmly press the shaver head against the surface being shaved while moving the shaver over that surface. However, many users of electrical shavers have found that this irritates their skin, particularly if the skin is somewhat moist. Many men who have tried electrical shavers have therefore discontinued using them and returned to wet shaving using a conventional blade.

OBJECTS AND BRIEF SUMMARY OF THE INVENTION

An object to the present invention is to provide an electrical hair remover device, particularly an electrical shaver, and also a method of removing hair, having advantages in the above respects.

According to one broad aspect of the present invention, there is provided an electrical hair remover device comprising a housing including an electrical motor; and a hair remover head driven by the electrical motor for removing hair from a surface over which the hair remover head is moved; characterized in that the hair remover head includes a static guard (i.e., static with respect to the hair remover head) having a face to be pressed against the surface from which the hair is to be removed as the remover head is moved over said surface, which face of static guard is formed with a plurality of openings therethrough; and in that the remover head further includes an air impeller driven by the electrical motor for discharging air through said openings such as to produce an air cushion between said face of the static guard and said surface, and thereby to reduce friction therebetween during the movement of the hair remover head over said surface.

The invention is particularly useful, and is therefore described below, as embodied in an electrical shaver, in which case the hair remover head is a shaver head. In the preferred embodiment described below, the cutter member is a rotary cutter member, and the air impeller is coupled to the rotary cutter member so as to be rotated with it.

The reduction in the friction resulting from the produced air cushion enables the device to more smoothly glide over the surface being shaved, and thereby to eliminate or reduce the irritation frequently experienced by users of electrical shavers. If the surface being shaved is somewhat damp, the air cushion produced by the device also tends to dry the surface thereby further reducing the friction.

According to further features in the described preferred embodiment, the static guard is formed with slots for receiving hairs to be cut by the rotary cutter member circumscribing the openings through which air impelled by the air impeller is discharged to produce the air cushion.

According to still further preferred features, the rotary cutter member is a circular disc formed around its outer periphery with a circular array of cutter teeth extending perpendicularly to the disc. The static guard is formed with a circular array of the hair receiving slots around its outer periphery and with the air discharge openings in a central region within the circular array of slots. The air impeller is fixed to the rotary cutter member within the circular array of cutter teeth, preferably by being integrally formed with the central hub of the cutter member.

As will be described more particularly below, such features enable the invention to be incorporated into existing rotary-type electrical shavers with a minimum of redesign and expense.

Further features and advantages of the invention will be apparent from the description below.

BRIEF DESCRIPTION OF THE DRAWINGS

The invention is described below, for purposes of example only, with reference to the accompanying drawings, wherein:

FIG. 1 is a three-dimensional view illustrating one form of electrical shaver with which the present invention is particularly useful;

FIG. 2 is an exploded perspective view illustrating the two members in each of the three shaver heads in the electrical shaver of FIG. 1 as modified to incorporate the present invention;

FIG. 3 is a plan view of the rotary cutter member in the shaver head of FIG. 2; and FIG. 4 is a plan view of the static guard member in the shaver head of FIG. 2.

DESCRIPTION OF A PREFERRED EMBODIMENT

The electrical shaver illustrated in FIG. 1 is a well known rotary-type electrical shaver, such as sold by Philips Corporation in Europe, or by Norelco Corporation in the USA. It includes a housing 2 of a configuration to be readily grasped by the user, and a shaver head assembly 3 at one end to be pressed against and moved across the user's face or other surface to be shaved. In this case, the shaver head assembly 3 includes three shaver heads 3*a*–3*c* mounted in a lid 3*d* defining, with the respective end of housing 2, a hair-receiving chamber (not shown) common to and underlying the three shaver heads. In the model illustrated in FIG. 1, lid 3*d* and its three shaver heads 3*a*–3*c* are removable from the housing to permit cleaning the hair-receiving chamber. In other models, this lid is pivotal with respect to the housing for cleaning the hair-receiving chamber.

The electrical shaver illustrated in FIG. 1 further includes an electrical motor, schematically shown at 4, within housing 2 and connected by a transmission, schematically shown at 5, for rotating the three shaver heads 3*a*–3*c* under the control of a manual switch 6. Motor 4 is powered by a rechargeable battery 7 within housing 2, and/or by an electrical cord (not shown). This particular model includes light indicators 8 indicating the charge status of the battery 7.

FIGS. 2–4 illustrate a preferred construction of one of the shaver heads, e.g. 3*a*, in accordance with the present invention, it being appreciated that the other two shaver heads (3*b*, 3*c*) are of the same construction.

Thus, as shown in FIG. 2, shaver head 3*a* is constituted of two main parts, namely a rotary cutter member 10, and a static guard 20. The rotary cutter member 10 is coupled to the motor transmission 5 so as to be rotated by the motor 4. The static guard 20 encloses the rotary cutter member 10. It is pressed against the user's face (or other surface being shaved), and includes hair-receiving slots penetrated by the hairs to be cut by the rotary cutter member.

The rotary cutter member 10, as more particularly illustrated in FIG. 3, includes a circular disc 11 formed around its outer periphery with a circular array of cutter teeth 12 extending perpendicularly to the disc, i.e. axially of the shaver head. A hub 13 is fixed to the center of circular disc 11. Hub 13 is formed with three radial arms 14 for coupling to the motor transmission 5. It is further formed, on its inner side facing the static guard 20, with a circular socket 15 for receiving the tip of a spacer pin carried by the static guard, as will be described more particularly below.

In the existing commercial construction of the cutter member 10, the circular disc 11 and its teeth 12 are of metal, whereas the central hub 13 is of hard plastic material.

According to the preferred embodiment of the present invention illustrated in the drawings, the hub 13 is integrally formed, on its inner side facing the static guard 20, with an air impeller 16 consisting of a plurality of vanes or blades 17 for impelling air through air discharge openings formed in the static guard 20, as will be described below, in order to produce an air cushion between the shaver head and the user's face (or other surface being shaved) during the use of the electrical shaver.

As shown in FIG. 3, the impeller vanes 17 occupy the central area of the circular disc 11 up to, or slightly spaced from, the annular array of teeth 12. The spaces 18 between the radial arms 14 of the hub 13 may serve as the inlet openings for the air drawn by the impeller vanes into the space between the cutter member 10 and the static guard 20, or additional openings may be provided for this purpose.

The static guard 20, more particularly shown in FIG. 4, is also made of metal. It includes an end wall 21 integrally formed with a cylindrical skirt 22 and an outer annular flange 23 for mounting the static guard within an opening in the lid 3*d* of the shaver head assmebly 3 (FIG. 1).

End wall 21 is formed with a circular array of hair-receiving slots 24 around its outer periphery. The central region 25 of end wall 21 includes a pin 26 extending inwardly so as to be received in socket 15 of the rotary cutter member 10 for spacing its teeth 12 very close to the inner face of the static guard 20 in alignment with the slots 24.

In accordance with the illustrated preferred embodiment of the invention, the central region 25 of static guard 20 is formed with a plurality of discharge openings 27 for discharging the air produced by the air impeller 16 during the rotation of the cutter member 10. The air so discharged produces an air cushion between the shaver head and the user's face (or other skin being shaved), and thereby reduces the friction during the movement of the electrical shaver over the user's skin. The thickness of the air impeller 16, including its vanes 17, is such that there is a slight space between the impeller vanes and the inner surface of the central region 25 of the static guard 20.

Preferably the static guard 20 further includes a cylindrical shield 28 around the periphery of the central region 25, i.e. inwardly of the slots 24, so as to direct most or all of the impelled air through openings 27, rather than through the slots 24. Shield 28 could be integrally formed with the static guard, or could be in the form of a plastic ring bonded to the static guard. Another alternative would be to integrally form the shield with hub 13 of the rotary cutter member, just outwardly of the outer tips of the impeller vanes 17.

It will thus be seen that during the operation of the electrical shaver, the impeller vanes 17 in all three shaver heads 3*a*–3*c* are rotated with their respective cutter members 10, to impel air through openings 27 in their respective static guards 20, thereby producing an air cushion between the electrical shaver and the user's skin being shaved. In each shaver head, this air cushion is concentrated by shield 28 through openings 27 in the central region 25 of the static guard 20. The so-produced air cushions thereby substantially reduce the friction between the electrical shaver and the user's skin as the electrical shaver is moved over the user's skin. These air cushions also tend to dry the user's skin, if damp, thereby further reducing friction. This reduction in the friction enables the electrical shaver to smoothly glide over the user's skin during the shaving operation.

Preferably, the air impeller vanes 17 are integrally formed with hub 13 of the rotary cutter member 10 in each shaver head 3*a*–3*c*, but it will be appreciated that the impellers could be separate elements otherwise fixed to the rotary cutter member. Further, while the invention has been described with respect to a rotary-type electrical shaver, it will be appreciated that the invention could be embodied in other types of electrical shavers such as the reciprocatory type, and in other types of hair remover devices such as electrical epilators particularly of the rotary type, to reduce or eliminate skin irritation caused by friction.

Many other variations, modifications and applications of the illustrated preferred embodiment will be apparent.

What is claimed is:

1. An electrical hair remover device, comprising: a housing including an electrical motor; and a hair remover head driven by said electrical motor for removing hair from a surface over which the hair remover head is moved; characterized in that:

said hair remover head includes a static guard having a face to be pressed against the surface from which the hair is to be removed as the remover head is moved over said surface;

said face of the static guard is formed with a plurality of openings therethrough;

and said remover head further includes an air impeller driven by said electrical motor for discharging air through said openings such as to produce an air cushion between said face of the static guard and said surface, and thereby to reduce friction therebetween during the movement of said hair remover head over said surface.

2. The device according to claim 1, wherein said device is an electrical shaver, and said hair remover head is a shaver head.

3. The device according to claim 2, wherein said shaver head includes a rotary cutter member enclosed by said static guard, and said air impeller is coupled to said rotary cutter member so as to be rotated therewith.

4. The device according to claim 3, wherein said static guard is formed with hair-receiving slots for receiving hairs to be cut by said rotary cutter member circumscribing said openings through which air impelled by said air impeller is discharged to produce said air cushion.

5. The device according to claim 4, wherein said rotary cutter member is a circular disc formed around its outer periphery with a circular array of cutter teeth extending perpendicularly to the disc; and wherein said static guard is formed with a circular array of said hair-receiving slots around its outer periphery and with said air discharge openings in a central region within said circular array of slots.

6. The device according to claim 5, wherein said electrical shaver has a plurality of said shaver heads each including a rotary cutter member enclosed by a static guard, and an air impeller also enclosed by the static guard and coupled to the rotary cutter member to be rotated therewith.

7. The device according to claim 5, wherein said air impeller is fixed to said rotary cutter member within said circular array of cutter teeth.

8. The device according to claim 7, wherein said rotary cutter member further includes a central hub coupled to the electrical motor for rotating the cutter member, and said air impeller includes a plurality of vanes integrally formed with said central hub.

9. The device according to claim 7, wherein said shaver head further includes a cylindrical shield between said circular array of slots and said central region of air discharge openings in said static guard for directing air from said impeller through said air discharge openings.

10. The device according to claim 9, wherein said cylindrical shield is integrally formed with said static guard.

11. The device according to claim 9, wherein said cylindrical shield is integrally formed with said central hub of the rotary cutter member.

12. The device according to claim 9, wherein said cylindrical shield is bonded to said static guard.

13. An electrical shaver, comprising:

a housing including an electrical motor; and a shaver head assembly including a plurality of shaver heads driven by said electrical motor for removing hair from a surface over which the shaver head assembly is moved;

each of said plurality of shaver heads including a rotary cutter member, and a static guard enclosing the rotary cutter member;

each of said static guards having a face to be pressed against the surface from which the hair is to be removed as the remover head is moved over said surface, said face of the static guard being formed with a plurality of openings therethrough;

and an air impeller for discharging air through said plurality of openings in said face of each static guard onto said surface from which hair is to be removed, such as to produce an air cushion between said static guards and said surface, and thereby to reduce friction therebetween during the movement of said electrical shaver over said surface.

14. The electrical shaver according to claim 13, wherein said air impeller includes a plurality of vanes fixed to each of said rotary cutter members so as to be rotated thereby and to produce said air cushion.

15. The device according to claim 14, wherein said rotary cutter member is a circular disc formed around its outer periphery with a circular array of cutter teeth extending perpendicularly to the disc; and wherein said static guard is formed with a circular array of hair-receiving slots around its outer periphery and with said air discharge openings in a central region within said circular array of slots.

16. A method of removing hair from a surface, comprising:

moving a hair remover head over said surface; said hair remover head including a static guard having a face which is pressed against the surface from which the hair is to be removed as the remover head moves over said surface, said face of the static guard having a plurality of openings therethrough;

and impelling air through said openings in said face of the static guard to produce an air cushion between said face of the static guard and said surface to reduce the friction therebetween during the movement of said hair remover head over said surface.

17. The method according to claim 16, wherein said hair remover head is a shaver head.

18. The method according to claim 17, wherein said shaver head includes a rotary cutter member, and said air cushion is produced by an air impeller fixed to said rotary cutter member so as to be rotated therewith.

19. The method according to claim 18, wherein said static guard encloses said rotary cutter member and is formed with a plurality of hair-receiving slots for receiving hairs to be cut by said rotary cutter member.

20. The method according to claim 19, wherein said electrical shaver has a plurality of shaver heads each including a rotary cutter member enclosed by a static guard, and an air impeller also enclosed by the static guard and coupled to the rotary cutter member to be rotated therewith.

* * * * *

UNITED STATES PATENT AND TRADEMARK OFFICE

CERTIFICATE OF CORRECTION

PATENT NO. : 5,909,928

DATED : June 8, 1999

INVENTOR(S) : Benjamin J. Barish

It is certified that error appears in the above-indentified patent and that said Letters Patent is hereby corrected as shown below:

On the title page: Item [30]

Foreign Application Priority Data
October 28, 1996 [IL] Israel 119506

Signed and Sealed this

Ninth Day of November, 1999

*Attest:*

*Attesting Officer*

Q. TODD DICKINSON

*Acting Commissioner of Patents and Trademarks*